United States Patent [19]

Mott

[11] 4,019,574

[45] Apr. 26, 1977

[54] SUBSURFACE WELL APPARATUS HAVING FLEXING MEANS AND METHOD OF USING SAME

[75] Inventor: James D. Mott, Houston, Tex.

[73] Assignee: Hydril Company

[22] Filed: May 23, 1975

[21] Appl. No.: 580,228

[52] U.S. Cl. ..... 166/.5; 166/156; 166/322

[51] Int. Cl.[2] ..... E21B 33/035; E21B 43/12

[58] Field of Search ..... 166/153, 155, 156, 176, 166/315, .5, 322

[56] References Cited

UNITED STATES PATENTS

| | | | |
|---|---|---|---|
| 3,052,302 | 9/1962 | Lagucki | 166/153 |
| 3,727,693 | 4/1973 | Tausch et al. | 166/156 |
| 3,732,928 | 5/1973 | Sizer | 166/156 |
| 3,764,176 | 10/1973 | Soulie et al. | 166/153 |
| 3,771,597 | 11/1973 | McGowen | 166/156 |
| 3,891,032 | 6/1975 | Tausch et al. | 166/156 |

FOREIGN PATENTS OR APPLICATIONS

| | | | |
|---|---|---|---|
| 945,232 | 12/1963 | United Kingdom | 166/153 |

*Primary Examiner*—James A. Leppink
*Attorney, Agent, or Firm*—Pravel, Wilson & Gambrell

[57] ABSTRACT

A surface-controlled subsurface safety valve apparatus and method of utilizing the safety valve in through-the-flowline serviced wells. Both the valve frame and valve operator are provided with ball and socket universal joints to enable passage of the safety valve past restrictions in the flowline resulting from bends and curves in the flowline by flexing the safety valve in moving to and from the subsurface operating location.

3 Claims, 8 Drawing Figures

Fig. 3
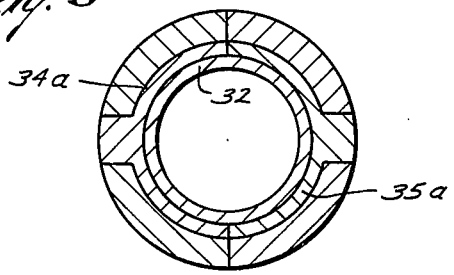
Fig. 7
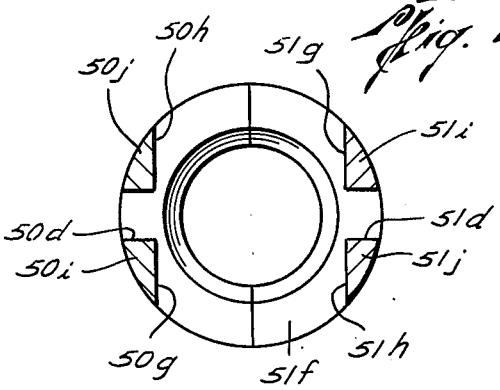
Fig. 4
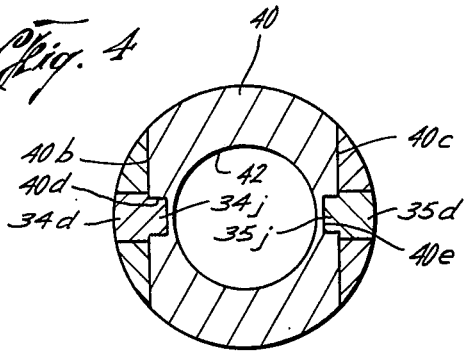
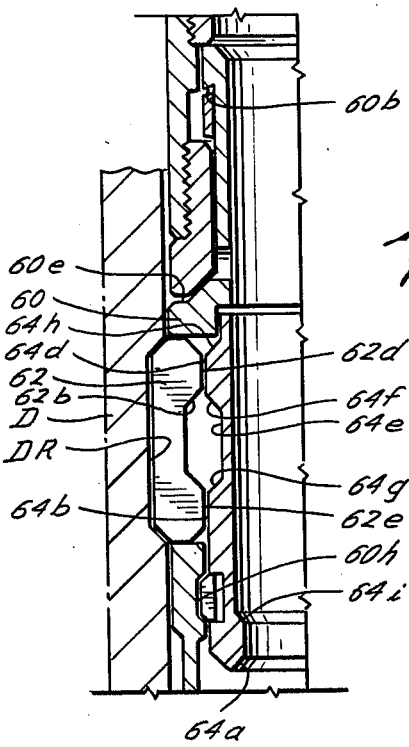
Fig. 12
Fig. 5
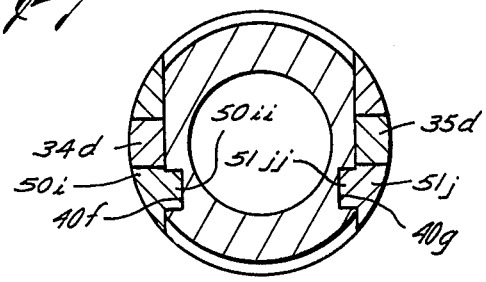
Fig. 6
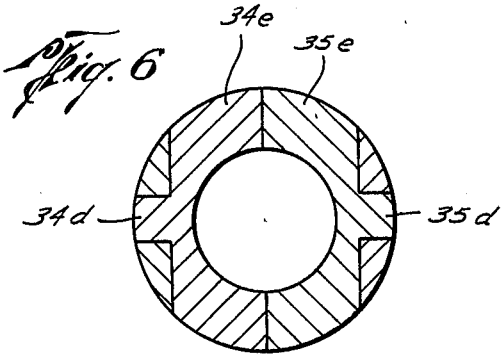
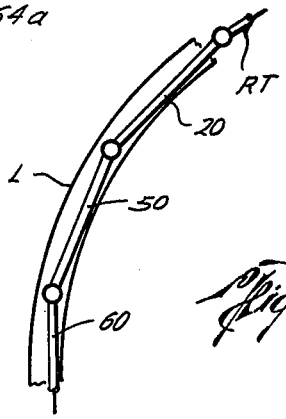
Fig. 13

70a

70
RT
70d
70b
80a
70c
72a
84
82
81
80
84a
84b
72b
76
72
72c
72e
74a
72d
74
80c
78
80b
74c
80d
78
87
74d
86
88b
88a
86a
89a
88
89
89b 94
93
90
94a
92
90b
90c
96
92a
90d
99
90a
100aa
98
98a
98b
100
100a
108
106a
106
100c
100
100b 102f
101
102d
102e
110b
112
102b
110a
102c
110
102
103
104

SUBSURFACE WELL APPARATUS HAVING FLEXING MEANS AND METHOD OF USING SAME

CROSS REFERENCE TO RELATED APPLICATIONS

The disclosures of this patent application is related to the disclosures of the following patent applications filed concurrently herewith:

1. Mott application Ser. No. 580,241, filed May 23, 1975, and entitled "Subsurface Well Apparatus Having Improved Operator Means and Method of Using Same", and 2. Miyagishima application Ser. No. 580,240, filed May 23, 1975, and entitled "Subsurface Well Apparatus".

BACKGROUND OF THE INVENTION

This invention relates to the field of subsurface well apparatus and method for using same.

Subsurface safety valves are sometimes employed as catastrophic protection systems in wells for controlling flow of well fluids from the well producing formation at a subsurface location below the well head to avert well flow under disaster conditions or failure of the surface flow control systems. Operation of such subsurface safety valves may either be controlled by the well conditions—differential or ambient pressure—directly sensed by the valve at the subsurface location (direct-controlled) or controlled from the surface by suitable control means (remote or surface-controlled). The differential pressure direct control valve is frequently and commonly referred to as the "velocity valve" or "Storm Chope" although the latter term is also used as a trademark. For a more detailed consideration of these types or categories of down hole or subsurface safety valves see the article entitled "Platform Safety by Down Hole Well Control" which appeared in the March 1972 issue of the *Journal of Petroleum Technology*, published by the Society of Petroleum Engineers, Dallas, Texas.

Early examples of rotatable ball-type surface controlled subsurface safety valves include Knox U.S. Pat. No. Re. 3,035,808, Fredd U.S. Pat. No. Re. 25,471 and Bostock U.S. Pat. No. 2,998,070. While these patents disclose the use of a rotatable ball-type flow closure element, other types of flow closure elements such as a flapper element as disclosed in Natho U.S. Pat. No. Re. 25,109 are also known. In general, these early surface-controlled subsurface safety valves were of the tubing retrievable type in that the upper and lower ends of the tubular valve housing were provided with means, normally threads, for connecting the valve housing in the production tubing and making the valve retrievable with the tubing, hence the designation of this type of valve as tubing retrievable. Mott patent application Ser. No. 427,978, now U.S. Pat. No. 3,901,321, considers a large number of prior art tubing retrievable type safety valve patents and reference is made to that disclosure for the purposes of incorporating that prior art herein. With a tubing retrievable type valve it is necessary to remove or pull the production tubing from the well in order to replace or repair the leaking or damaged valve and such tubing removal and installation operations are both expensive and hazardous and may result in permanent damage to the producing formation.

In order to overcome this problem with tubing retrievable valves, surface controlled wireline retrievable valves were developed such as disclosed in U.S. Pat. No. Re. 26,149 and U.S. Pat. No. 3,667,505. In general, these through-the-bore movable or wireline retrievable valves severely restricted the flow area through the valve due to the manner of their operation which required pressure responsive surfaces for the control fluid to be carried by the wireline retrievable valve.

Some attempts to overcome the disadvantages found in the prior art have used a combination of a surface-controlled tubing retrievable valve receiving and operating a wireline retrievable valve with the controls of the tubing retrieval when the tubing retrievable valve fails. U.S. Pat. No. 2,998,077 discloses the concept of locking a tubing retrievable valve open to conduct well operations through the valve while Canadian Pat. No. 955,915 and corresponding United States application Ser. No. 72,034, now abandoned, after filing continuation application Ser. No. 256,194 discloses the concept of releasably locking the tubing retrievable valve open. Such an arrangement is also disclosed in U.S. Pat. Nos. 3,696,868 and 3,868,995.

Mott U.S. Pat. No. 3,763,933 discloses the combination of a tubing retrievable valve and a wireline retrievable valve in which the wireline retrievable valve is operated off the controls of the tubing retrievable valve without the tubing retrievable valve being locked open.

Mott U.S. Pat. No. 3,762,471 also discloses a tubing retrievable valve that is locked open and the wireline retrievable valve operated off the controls of the tubing retrievable. That patent further disclosed the use of a movable landing ring for operably positioning the wireline retrievable valve in the tubing retrievable valve for releasably securing.

Mott U.S. Pat. No. 3,744,564 disclosed an improved wireline retrievable or drop-in valve in which the drop-in valve operator sleeve was secured with the reciprocating tubular operator of the tubing retrievable valve to assure positive operation of the wireline valve. The wireline retrievable valve disclosed in these three Mott patents considered immediately above and their divisional applications did not carry the pressure responsive surfaces and did provide for a ball closure element having a diameter substantially equal to the outer diameter of the wireline retrievable valve housing in order to increase the flow area through the wireline retrievable valve.

Mott U.S. Pat. No. 3,858,650 discloses a dual controlled tubing retrievable housing without a flow controlling valve element for receiving and operating the through-the-flowline retrievable valve disclosed in U.S. Pat. No. 3,744,564 with either control line.

The technology for completing wells drilled in the ocean with subsurface safety valves controlled from platforms remote from the well head has been developed. For example, U.S. Pat. No. 3,633,669 discloses a tubing retrievable ball-type subsurface safety valve automatically controlled from a remote operating or production platform by control fluid supplied to the valve through an inner tubing. Should the disclosed tubing retrievable valve be damaged for any reason it is necessary to move a work over vessel over the submerged well head assembly to pull the well tubing to replace the valve.

The technology of servicing offshore wells remote from a producing platform has also resulted in the development of through-the-flowline (TFL) movable tools that are circulated to and from the well through the well flowline to eliminate the need for a work over vessel to be positioned over the well head. U.S. Pat. No. 3,608,631 discloses a typical apparatus for pumping TFL tools into and out of a well while U.S. Pat. Nos. 3,331,437 and 3,601,190 disclose typical well head apparatus or Christmas trees having curved flowline loops of sufficient radius to enable passage of the TFL tools. The disclosed well head apparatus provided alternate access for the work over vessel positioned over the well head in order that wireline retrievable surface-controlled subsurface safety valves could be run into and out of the well.

U.S. Pat. No. 3,308,880 discloses a typical flexible pumpable tool carrier apparatus or locomotive developed for TFL operations of installing and retrieving well tools and sets forth at length some of the problems encountered in such TFL operations due to curves in the flowlines fouling or hanging up the TFL tools. The well tool disclosed as being installed is identified as a shortened "storm choke" to enable passage through curves in the flow line.

SUMMARY OF THE INVENTION

This invention relates to a new and improved subsurface well apparatus and method of using the same.

A subsurface safety valve apparatus of the surface-controlled type is formed with one or more universal joints to enable the safety valve to be installed and retrieved from a subsurface location in a well to a working platform remote from the well head utilizing through-the-flowline techniques. The universal joints are of the ball and socket type and enable the safety valve to flex or bend around restrictions provided by bends as curves in the flowline to enable passage about the restriction. Methods of installing and retrieving the surface-controlled vavle through the wall head apparatus and flowline by flexing is set forth.

An object of the present invention is to provide a new and improved subsurface well apparatus.

A further object of the present invention is to provide a new and improved method of using a subsurface well apparatus.

Yet another object of the present invention is to provide a new and improved subsurface well apparatus and method of using the subsurface well apparatus.

BRIEF DESCRIPTION OF THE DRAWINGS

FIGS. 3, 4, 5, 6 and 7 are views taken along lines 3—3, 4—4, 5—5, 6—6 and 7—7, respectively, of FIGS. 2A and 2B;

FIG. 12 is a side view, in section, of the operation after the initial closing of the safety valve; and FIG. 13 is a schematic side view, in section, illustrating the flexing of the safety valve in moving through a loop of the flowline.

DESCRIPTION OF THE PREFERRED EMBODIMENT

Figure 1:
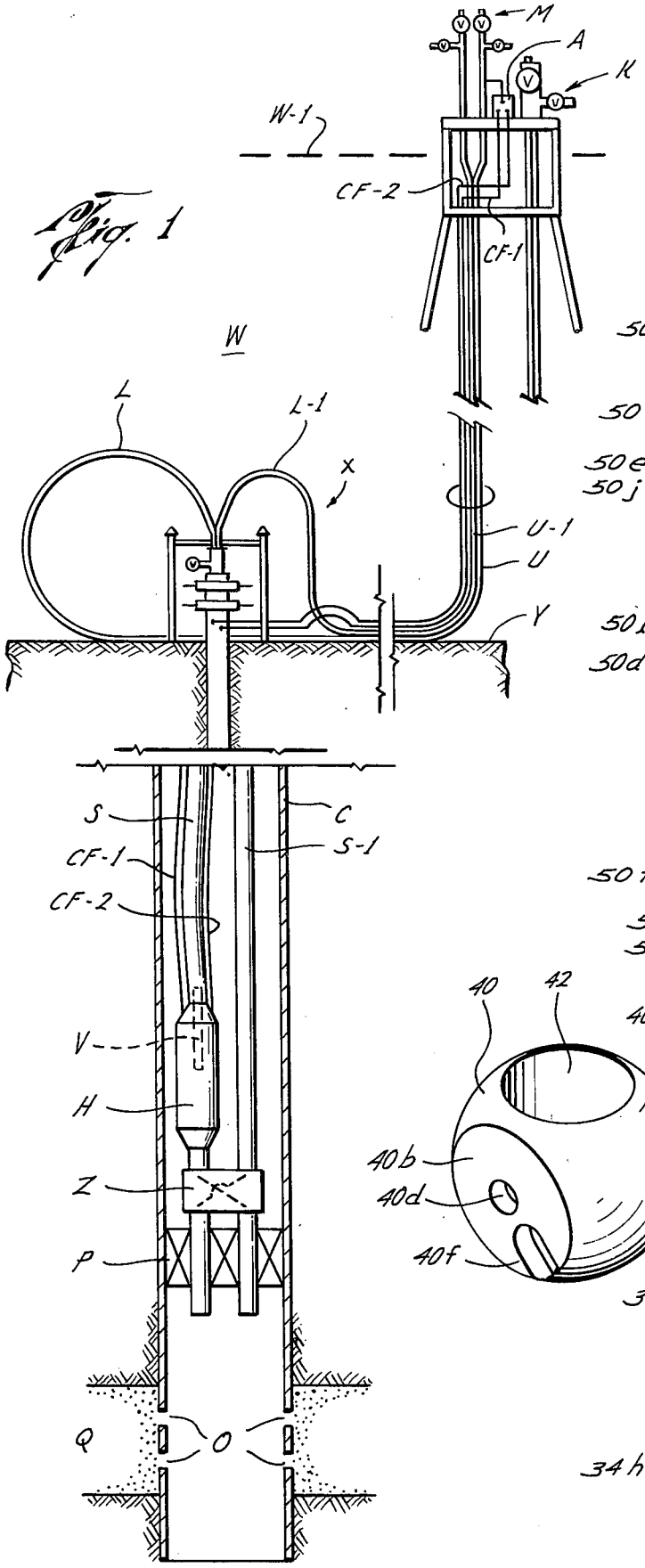
FIG. 1 is a schematic view, partially in section, of a submerged well head completion remote from a producing platform with the well apparatus of the present invention operably positioned at a subsurface location in the well.

The present invention is preferably employed in a well environment such as that schematically illustrated in FIG. 1. A well head apparatus or christmas tree, generally referenced as X, is secured at the top of a well casing C which extends downwardly in the well and which is provided with a plurality of perforations O for enabling flow of well fluids from a producing formation Q into the casing C. Preferably, one or more tubing strings are positioned within the casing C in conjunction with a packer P as is well known in the art. Whenever it appears desirable to service a well using through-the-flowline (hereinafter TFL) techniques the well is preferably completed using a pair of parallel production tubing strings S and S-1 and employing a tubing cross over tool Z to establish flow communication between the well tubings S and S-1 during TFL operations. The cross over tool Z may be of the type disclosed in U.S. Pat. No. 3,865,191, but in the case of a single tubing completion in which the well annulus between the tubing and the casing is employed as a TFL circulation channel, a well tool such as disclosed in U.S. Pat. No. 3,750,752 may be employed. The completion schematically illustrated in FIG. 1 is a dual string with a single zone completion, but those skilled in the art may employ the present invention in wells having other completion arrangements.

Connected in the tubing S and forming a portion thereof at a desired subsurface location is a tubing retrievable housing H such as disclosed in U.S. Pat. Nos. 3,858,650 or tubing retrievable safety valve such as disclosed in Patent 3,744,564. The housing H is adapted to receive and operate the subsurface safety valve V of the present invention which is illustrated in phantom operably positioned in the housing H in FIG. 1.

The christmas tree X may be of any typical underwater completion well head assembly, such as those disclosed in previously mentioned patents, U.S. Pat. Nos. 3,331,437 and 3,601,190. Such christmas trees X are designed to operate on the earth's surface submerged in a body of water W and provide surface flow control of well fluids.

The christmas tree X serves to place the well tubings S and S-1 in flow communication with the flow conduit or pipe lines U and U-1, respectively. The christmas tree X is provided with connectors or curved flowline loops L and L-1 of sufficient radius to permit the passage of tools between the substantially horizontal flowlines U and U-1 and the substantially vertical well tubings S and S-1, respectively. While it is preferable that the loops be formed of as great a diameter as possible, the subsurface safety valve V of the present invention is designed for passing through a well head connector loop having a radius of 5 feet.

The flowlines U and U-1 extend from the well head apparatus and may be run to a producing or operating platform K that may be located a considerable horizontal distance from the christmas tree X above the surface W-1 of the body of water W. Disposed on the platform K is a suitable manifold means M for the flowlines U and U-1 as well as the surface-controls for the subsurface safety valve V of the present invention. The manifold system M may be of the type disclosed in U.S. Pat. No. 3,608,631, but other manifold arrangements for controlling well flow and conducting TFL operations are known to those skilled in the art. The safety valve surface controller A may be one of many commercially available types or the type disclosed in U.S. Pat. No. 3,035,808. The surface-controller A supplies control fluid pressure to the housing H through either control fluid conduit CF-1 or CF-2 which are run along side the flow conduits U and U-1 from the platform K to the christmas tree X and downwardly within the casing C to the tubing retrievable housing H for commuicating with expansible control fluid chambers in the housing H to effect longitudinal movement of a control member D (FIG. 12).

In the tubing retrievable housing disclosed in U.S. Pat. Nos. 3,744,564 and 3,858,650 a movable landing ring (illustrated as LR in FIG. 11C) is disposed in the tubular housing that is radially constrictable when control fluid pressure is communicated through control fluid conduit CF-1 and CF-2 in a specified manner to provide a no-go stop or barrier positioning means for operably securing the subsurface safety valve V of the present invention in the housing H. The housing H also provides for the releasably securing of the safety valve V within the housing H at a predetermined desired location so that the safety valve V will be responsive to movement of the control member D that is reciprocally mounted with the housing H and movable in response to the application of increased control fluid pressure. Movement of the control member D by the application of increased control fluid pressure through either one of the control fluid conduits CF-1 and CF-2 will overcome a spring biasing on the control member D to move the control member D for operating the safety valve V open. Preferably, the control member D is normally biased to an upper position by a spring (not illustrated) mounted with the housing H and is moved to the lower position by the urging of control fluid pressure. To provide desired fail-safe operation, the subsurface safety valve of the present invention is arranged to be operated to the closed position when the control member D is in the upper position and to be pulled or operated to the open position by the downward movement of the control member D in response to the application of increased control fluid pressure.

Figures 2A, 2B:
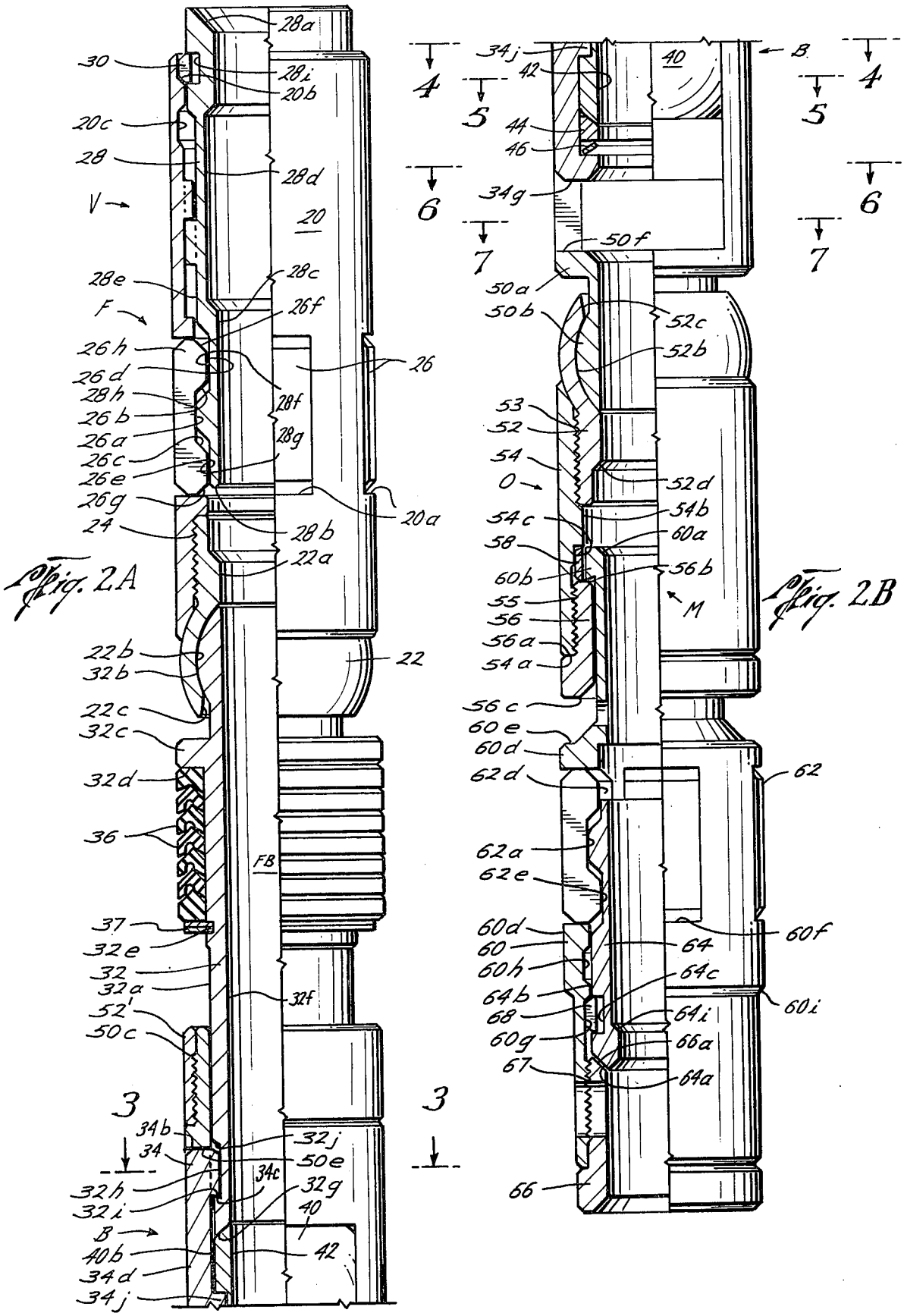
FIG. 2A and 2B are side views of the subsurface safety valve of the present invention arranged in alphabetical sequence from top to bottom of the safety valve.

Referring now to FIGS. 2A and 2B which illustrate the TFL valve in alphabetical sequence from top to bottom, the TFL valve will be described in detail. The flexing articulated TFL valve means V of the present invention may be considered as having three basic operating means. A frame means, generally designated F, carries a bore closure means, generally designated B, and an operator means, generally designated M, that is operably connected with the bore closure means B for effecting control operation of the bore closure means B.

The frame means F is preferably formed by a plurality of substantially tubular members connected for ease of assembly to form a substantially tubular unit or assembly that extends downwardly from the upper portion of the valve V to a location below the bore closure means B. In the disclosed preferred embodiment, an upper main frame sleeve 20 is secured to a connecting member 22 by a suitable means such as threaded engagement at 24. The frame connecting member or socket 22 is formed in two portions by longitudinally bisecting or splitting the sleeve forming the socket 22 for ease of assembly and which portions are held by threaded engagement 24 as a single tubular socket member 22. The socket 22 forms an inner diameter surface **22*a* having an annular spherical recess or ball receiving socket cup 22*b*. The portion of the surface 22*a* below the cup 22*b* is tapered at 22*c* to provide sufficient clearance to enable the longitudinal axis of the tubular sleeves 20 and 22** to gimble or flex relative to the longitudinal axis of the remaining portion of the frame means F.

The safety valve V includes means for releasably securing in the housing H that are disclosed as provided by a plurality of latch dogs 26 and a frame latch sleeve 28. The four dogs 26 are preferably movably disposed in a plurality of four equi-circumferentially spaced windows **20*a* formed in the frame sleeve 20 and which are radially movable from a released or inner position (FIG. 2A) to a locking or extending position (not illustrated) where they are received in an annular recess formed in the bore of the housing H for blocking movement through the bore of the well tubing S. Each of the dogs 26 is provided with a central inner recess 26*a* having tapered upper and lower recess wedging surfaces or edges 26*b* and 26*c*, respectively, leading to dog latching or lockng surfaces 26*d* and 26*e*, respectively, and which are provided with tapered outer wedging shoulders 26*f* and 26*g*, respectively. Outwardly projecting tapered side flanges 26*h* prevent each of the dogs 26 from moving out of the respective windows 20*a* and serve as a movement limit stop for the outwardly extending dogs 26** in the locking position.

The latch sleeve 28 is longitudinally movable relative to the frame sleeve 20 and is disposed within the frame sleeve 20. The latch sleeve 28 extends downwardly from an upwardly facing annular actuating shoulder **28*a* to a downwardly facing annular shoulder 28*b* adjacent the lower portion of the latch dogs 26. The tubular latch sleeve 28 includes an inner or bore defining surface 28*c* having an operating recess 28*d* formed therein. When the sleeve 28 is in the upper or latch dog release position recesses 28*f* and 28*g* formed in the outer surface 28*e* are positioned adjacent locking surfaces 26*d* and 26*e*, respectively, of the latch dogs in order that the latch dogs may move radially inwardly. Disposed between the recesses 28*f* and 28*g* is a locking surface 28*h* that is a companion locking surface to that formed by the outer surface 28*e* immediately above the recess 28*f*. When the latch sleeve 28 moves to the lower or latch dog locking position relative to the frame 20 the tapered edges of the recesses 28*f* and 28*g* wedge or force the latch dogs 26 radially outwardly as the locking surfaces 28*h* and 28*e* move downwardly relative to the dogs 26 to be positioned adjacent the locking surfaces 26*e* and 26*d* of the latch dog, respectively, for latching the dogs 26** in the locking position.

The latch sleeve 28 is connected with the frame sleeve 20 by a suitable means to enable the desired reciprocating movement of the latch sleeve 28 relative to the frame sleeve 20 to effect movement between the released and latched or locking positions. In the embodiment illustrated in FIG. 2A a breach lock arrangement is illustrated but a different arrangement such as that illustrated in U.S. Pat. No. 3,744,564 may be employed. The latch sleeve 28 carries a radially expansible detent split ring 30 in a recess **28*i* formed on the outer surface 28*e* of the latch sleeve 28. When the latch sleeve 28 is in the upper position the detent 30 is in the position illustrated in FIG. 2A where it engages an upwardly facing tapered annular shoulder 20*b* to prevent inadvertent downward movement to the latching position and when the latching sleeve 28 moves to the lower or latching position the detent ring 30 is radially constricted until adjacent a latching recess 20*c* and into which the detent 30 expands to prevent inadvertent movement of the latching sleeve 28** from the latched position.

The remaining portion of the frame means F includes a tubular frame sealing sleeve or member 32 and a ball connecting cage member 34. The frame sealing sleeve 32 forms an outer surface **32*a* having a ball or spherical enlargement 32*b* formed thereon for being received within the socket 22*b* of the connecting member 22 for enabling angular flexibility between the longitudinal axis of the sleeve 32 and the common longitudinal axis of the sleeves 20 and 22. This articulated universal joint enables the flexing of the frame means F in moving through the bends in the well tubing such as loops L and L-1 while connecting or securing the sleeve 32 with the sleeve 20 and 22. Below the ball enlargement 32*b* the outer surface 32*a* is provided with an outwardly projecting collar 32*c* forming a downwardly facing annular shoulder 32*d*. The annular shoulder 32*d* provides an upper limit stop for the sealing or packing means provided by a plurality of chevron packing rings 36. The packing rings 36 serve to seal the outer surface 32*a* of the sealing sleeve 32 with the tubing retrievable housing H to block flow of well fluids between the tubing retrievable housing H and the frame means F. The packing rings 36 are secured adjacent the downwardly facing shoulder 32*d* by snap rings 37 that are received in an annular recess 32*e* disposed immediately below the chevron packing rings 36.**

The sealing sleeve 32 includes an inner surface **32*f* partially defining a flow passage or frame bore FB through the frame means F and which inner surface 32*f* continues downwardly to adjacent the bore closure means B where the sealing member 32 is provided with a downwardly facing annular arcuate sealing shoulder 32*g* for a purpose to be set forth hereinafter. When the packing 36 effects a flow blocking seal with the housing H, the flow of well fluids from the formation Q to the wall head assembly X passes through the frame bore FB. Formed on the outer surface 32*a* a short distance above the downwardly facing sealing surface 32*g* is an annular recess 32*h* providing an upwardly facing annular shoulder 32*i* and a downwardly facing annular shoulder 32*j*.**

Figure 8:
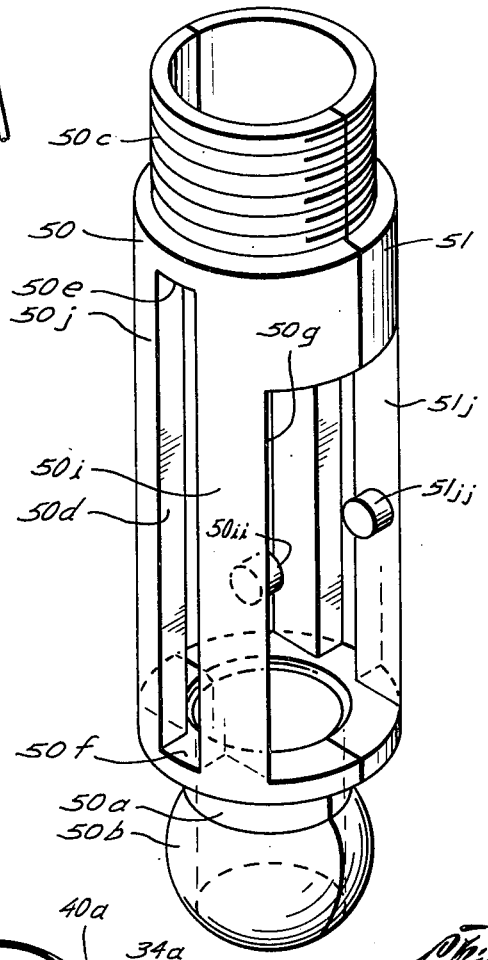
FIG. 8 is an isometric view of the rotatable ball element and the associated members surrounding the ball when assembled.
Figure 8:
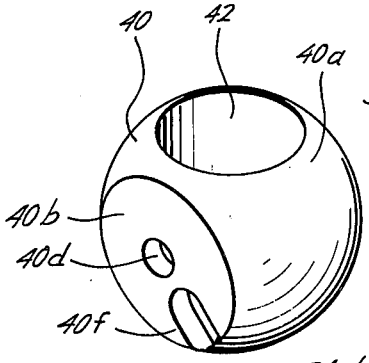
Figure 8:
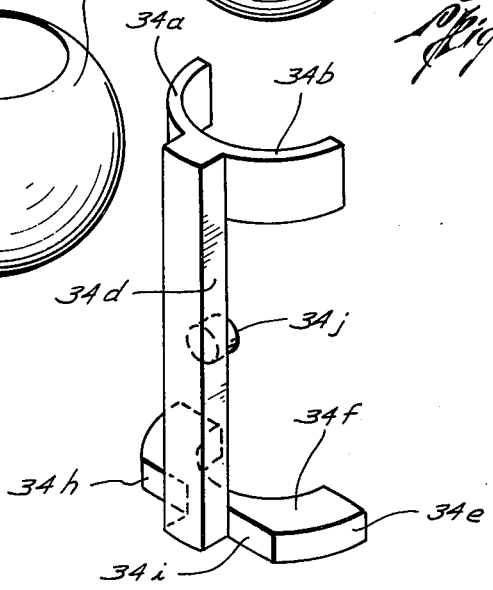

The cage 34 is connected with and extends downwardly from the sealing member 32 and may be best described as a longitudinally bisected or split tubular unit in a rather complex shape and having a substantial portion machined or otherwise removed to provide clearance for the longitudinal movement necessary to effect operation of the bore closure means B. As best illustrated in FIG. 8, the cage 34 is formed by two identical mating portions of spaced parallel rings connected by a longitudinally extending fingers.

As the cage 34 is formed of identical halves, only one half will be described but it is to be understood that two halves are utilized in the present invention. The cage 34 is provided with an upper ring portion **34*a* forming an upwardly facing annular shoulder 34*b* and a downwardly facing annular shoulder 34*c*. As best illustrated in FIG. 2A, the ring portion 34*a* extends inwardly a greater distance than the longitudinally extending rib or finger portion 34*d* to enable the upper ring 34*a* to be received within the recess 32*h* of the frame sealing sleeve 32 in order that the upper and lower annular surfaces 34*b* and 34*c* of the cage 34 will engage the shoulders 32*j* and 32*i* of the sealing frame 32 for connecting the cage 34 with the sealing sleeve 32. The rib 34*d* extends downwardly from the upper ring portion 34*a* to a lower ring portion 34*e* forming an upwardly facing annular shoulder 34*f* and a downwardly facing annular shoulder 34*g*. The outer portion of the lower ring 34*e* is notched at 34*h* and 34*i* to enable longitudinal operator movement relative to the cage 34 as will be set forth in greater detail hereinafter. The rib 34*d* mounts an inwardly projecting pivot pin 34*j* for a purpose to be set forth in greater detail hereinafter. In the sectional views of FIGS. 3–7, the identical mating half of the cage 34 is referenced with the identical alphabetical character but with the numerical reference character changed to 35.**

The plug or bore closure means B is disposed within the cage 34 and preferably includes a rotatable ball member 40 having an opening 42 formed therethrough. As best illustrated in FIG. 8, the ball member 40 is formed with an outer spherical surface **40*a* and a pair of parallel chordal flats 40*b* and 40*c* as is well known in the art. Each of the circular chordal flats 40*b* and 40*c* are provided with a concentric recess 40*d* and 40*e*, respectively, for receiving the inwardly projecting pins 34*j* and 35*j* carried by the fingers 34*d* and 35*d* of the cage 34 for mounting the ball 60 with the frame means F. Each of the flats 40*b* and 40*c* have a second recess 40*f* and 40*g*, respectively, spaced from the concentric recess for rotating the ball 40. Alternately, diagonally extending slots on the flats 40*b* and 40*c* may be used. The outer sperhical surface 40*a* of the ball engages the downwardly facing arcuate sealing shoulder 32*g* of the frame sealing sleeve 32 for effecting a continuous annular fluid seal between the ball member 40 and the frame sleeve 32.**

The ball 40 is rotatable to and from a first or open position with the flow opening 42 aligned with the bore FB of the frame means F to enable flow of fluid through the safety valve V and a closed position with the opening 42 disposed substantially transverse and out of communication with the bore FB of the frame means F in order that the ball 40 will serve to block flow of fluid through the valve V. The opening 42 is preferably formed of substantially the same diameter as the diameter of the surface **32*f* defining the bore through the sleeve 32 in order to provide as large a flow opening through the safety valve V as possible. To further enhance this feature, the outer spherical surface 40*a* is formed of a diameter substantially equal to the outer diameter of the cage 34 and which is best illustrated in FIG. 4.**

The bore closure means B further includes a follower 44 having an upwardly facing arcuate surface **44*a* engaging the lower portion of the spherical surface 40*a* of the ball 40 for urging the ball 40 upwardly into sealing engagement with the seat 32***g*. A biasing spring 46 is disposed between the lower follower seat 44 and the upwardly facing annular shoulder 34*f* provided by the lower ring portion of the cage 34 to maintain the ball 40 in sealing engagement with the seat 32*g*.

The operator means M effects opening and closing rotational operation of the ball 40 and extends downwardly from a location slightly above the ball 40 to the lower end of the TFL valve V. The operator means M, as will be considered in detail hereinafter, is also provided with the flexing or universal joint means between the upper and lower portions of the operator in order that the valve V may flex in a plurality of locations to enable the tool to pass through flowline loops L and L-1 curved on a 5 foot radius.

The operator means M includes a ball moving member 50 disposed adjacent to and movable relative to the cage member 40. As best illustrated in FIG. 8, the ball moving member 50 is a longitudinally bisected or split sleeve unit that extends downwardly from above the upper cage ring 34 with an outer surface 50*a* terminating in an enlarged spherical or ball portion 50*b* providing half of a universal joint connection for the operator means M as will be set forth in greater detail hereinafter. A securing ring 52' is disposed above the cage 34 and is secured to the split member 50 by suitable means such as engagement with threads 50*c*. Thus the member 52' serves to hold or secure the split member 50 as a unit for reciprocating movement relative to the cage 34 and the ball 40. As with the cage 34 the ball moving member 50 is formed of two substantially identical portions and as with the cage member 34 only half of the valve moving member 50 will be considered in detail and the numerical reference character 51 will be reserved for use with the identical alphabetical reference characters to designate identical portions of the mating part.

The ball moving member 50 is provided with a longitudinal slot 50*d* forming a downwardly facing upper stop limit shoulder 50*e* and an upwardly facing lower annular stop shoulder 50*f*. The slot 50*d* receives therein the longitudinal extending finger 34*d* of the cage 34 to enable limited relative longitudinal movement between the cage 34 and the ball moving member 50. The length of the stroke or reciprocating movement enabled therebetween is best illustrated in FIG. 2B by observing the distance between the annular shoulders 34*g* and 50*f* which engage to block further relative movement of the operator means M upwardly towards the frame means F. AS illustrated in FIG. 2B, the engagement of the upwardly facing annular shoulder 34*b* of the cage 34 with the downwardly facing shoulder 50*e* of the slot 50*d* limits downward movement of the ball moving sleeve 50 relative to the cage 34. The ball moving member 50 is also slotted at 50*g* and 50*h* to form portions of ball clearance windows which enable the rotational movement of the ball 40. Referring now to FIG. 7 the relative sizes of the slots 50*d* and 51*d* and the ball clearance windows becomes apparent. The slots 50*d* and 51*d* provide clearance for the ball cage fingers 34*d* and 35*d* and which are illustrated positioned in those slots in FIG. 4. The ball movement enabling windows is provided by the cooperating slots formed by the surfaces 50*g* and 51*h* on the lower portion of FIG. 7 and the slots 50*h* and 51*g* on the upper portion of FIG. 7. Thus, each portion of the ball moving member 50 forms a pair of longitudinally extending ribs or fingers 50*i* and 50*j*, respectively, that are located adjacent the ball 40. Referring now to FIG. 5 the relationship of the eccentric pins carried by the fingers 50*i* and 51*j* is illustrated. These two fingers, 50*i* and 51*j* carry eccentric pivot pins 50*ii* and 51*jj* that engage eccentric recesses 40*f* and 40*g* in the ball 40 for effecting rotational movement of the ball 40 to and from the open and closed positions upon longitudinal movement of the control member 50 relative to the ball 40 as is known.

The operator means M includes a longitudinally split coupling or tubular socket member 52 having an inner surface 52*a* forming a spherical annular recess 52*b* adjacent the enlarged ball portion 50*b* of the ball moving member 50 to provide the articulate or flexible joint for the operator means M. The spherical cup or socket surface 52*b* is cut away at 52*c* in a manner similar to that to the surface 22*c* is cut away from the socket 22*b* to provide sufficient clearance.

The operator means further includes an operator coupling sleeve member 54 disposed adjacent the lower portion of the socket 52 and which is secured to the socket 52 by suitable means such as threaded engagement at 53. The sleeve 54 functions to hold the split sections of the cup 52 from separation and thereby maintaining the cup member 52 connected with the upper portion of the ball surface 50*b* of the ball moving member 50. Secured to the lower portion of the sleeve 54 is a keeper or securing ring 56 which threadedly engages the inner surface 54*b* of the sleeve 54 at 55. The stop or securing ring 56 is also a longitudinally split member which is held together as a unit by the threaded engagement at 55. Locking ring 56 provides upwardly facing shoulder 56*a* which engages a downwardly facing annular shoulder 54*a* of the member 54 when the locking ring 56 is secured with the sleeve 54. The inner surface 54*b* of the sleeve 54 forms a recess 54*c* above an upwardly facing shoulder 56*b* of the locking ring 56. Disposed within the recess 54*c* is a radially expanded contractable split detent ring 58 for a purpose to be set forth hereinafter.

The operator means M further includes an operator sleeve 60 which extends downwardly from adjacent the securing ring 56 to the lower end of the tool. The operator latching sleeve 60 forms an upwardly facing annular shoulder 60*a* and adjacent the detent 58 in FIG. 2B an outwardly extending collar 60*b* serves to maintain the detent 58 in the recess 54*c* and provides a downwardly facing annular shoulder 60*c* engagable with the shoulder 56*b* for connecting the operator sleeve 60 with the securing ring 56 when the safety valve V is moving to be installed in the housing H. The operator sleeve 60 is formed with an enlarged outer portion 60*d* forming an upwardly facing annular stop shoulder 60*e* which engages the downwardly facing annular shoulder 56*c* of the locking ring 56 upon initial closing operation of the ball 40.

The operator latch sleeve 60 has a plurality of rectangular windows equi-circumferentially spaced on the large diameter portion 60*d*. Each of the windows 60*f* receives a movable latch dog 62 similar to the latch dogs 26 movably disposed in the windows 20*a* of the frame sleeve 20. The alphabetical reference characters employed with the latch dogs 62 are identical to the alphabetical reference characters of the latch dogs 26 and reference is made to the earlier disclosure for describing the similar structure and operation of the latch dogs 62.

The operator latch sleeve 64 cooperates with the latch dog 62 to accomplish the same result as the latch sleeve 28 effects with the dogs 26, but the operating positions of the latch sleeve 64 is reversed.

When the latch sleeve 64 is in the lower or released position (FIG. 2A) the dogs 62 are able to move radially inwardly, but when the latch sleeve moves to the upper position relative to the operator sleeve 60 (FIG. 12) the latch dogs 62 are wedged radially outward to the locking position for securing the operator sleeve 60 with the control member D for effecting longitudinal reciprocating movement of the operator means M. As illustrated in FIG. 12, the control member D is provided with an annular recess DR into which the dogs 62 may be expanded. The housing is provided with a similar recess for the dogs 26.

Referring now to FIG. 2B the operator sleeve 60 has secured thereto at its lower end a keeper ring 66 which is secured thereto by suitable means such as threaded engagement at 67. The keeper ring 66 provides an upwardly facing annular surface **66*c* that serves as a lower limit stop for the operator latch sleeve 64**.

The operator latch sleeve 64 is provided with a downwardly facing annular shoulder **64*a* engaging the latch locking ring shoulder 66*a* for forming a lower limit stop for the operator latch sleeve 64. The latch sleeve 64 defines an outer locking surface 64*b* engageable with the lower locking surface 62*e* of the dogs 62 for holding the dog in the locking position when the sleeve 64 moves to the upper position. The locking surface 64*b* is provided with a recess 64*c* in which a radially contractable gapped latch sleeve detent 68 is located. The latch sleeve detent 68 is substantially similar in operation as the frame latch sleeve detent 30 to prevent inadvertent movement of the operator means latch sleeve. The detent 68 is carried with the latch sleeve 64 from a lower recess 60*g* of the operator sleeve 60 to a upper recess 60*h* when the latch sleeve 64** moves from the lower to the upper or locking position.

As best illustrated in FIG. 12, the latch sleeve 64 in the upper locking position places the latch sleeve locking surfaces **64*b* and 64*d* adjacent the dog locking surfaces 62*e* and 62*d*, respectively, of the latch dogs 62 for holding or locking the latch dogs 62 radially outwardly within the recess DR. A recess 64*e* having tapered upper and lower shoulders 64*f* and 64*g*, respectively, receives the locking surface 62*e* when the latch sleeve 64 moves to the lower position (FIG. 2B) while upwardly facing tapered surface 64*h* cooperates with the corresponding tapered surface 62*b* of the latch dogs 62 to provide inward movement clearance for the locking surface 62*d* when the latch sleeve 64** is in the lower position.

Figures 9A, 9B, 9C:
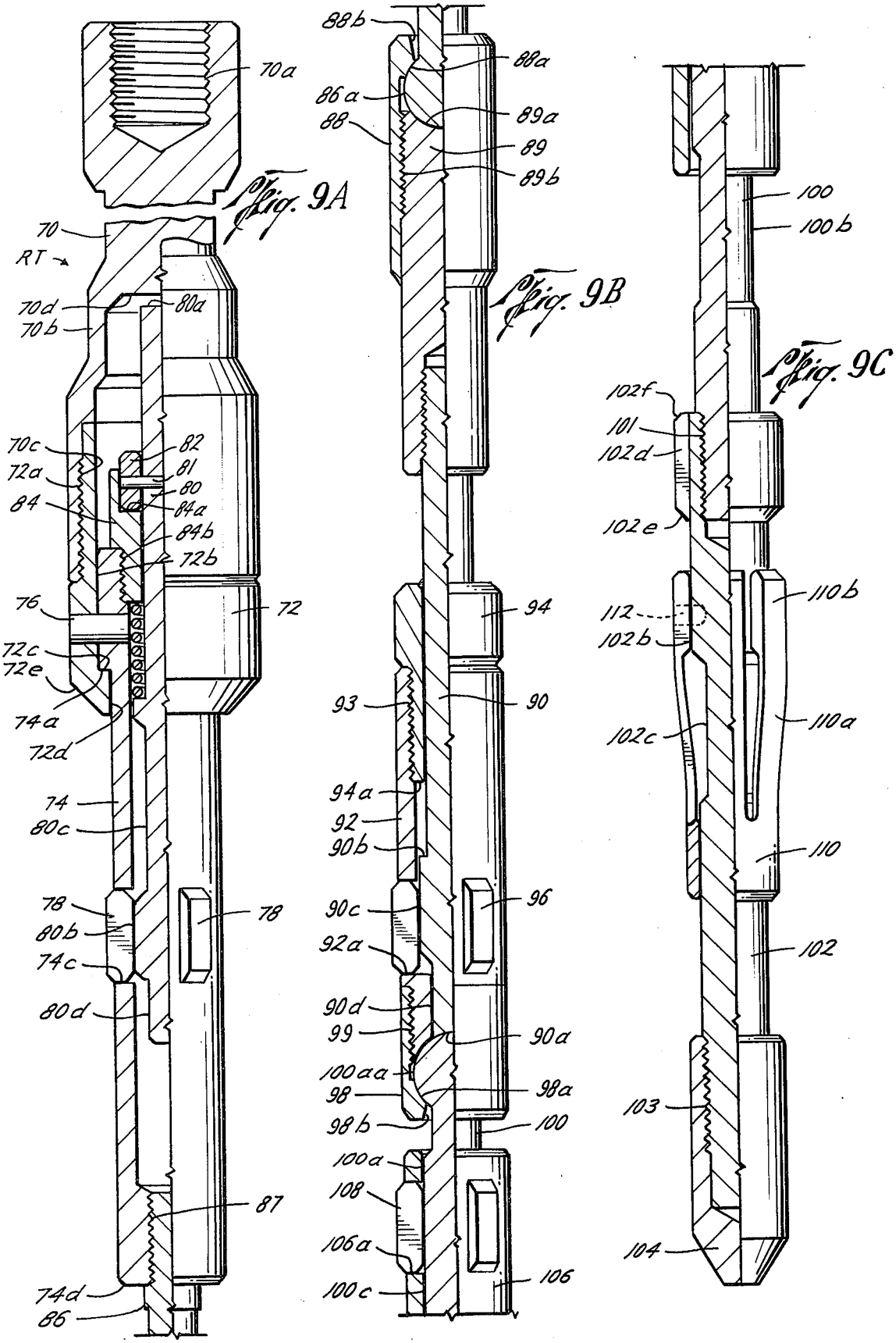
FIGS. 9A, 9B and 9C are side views of the subsurface safety valve running or installation tool of the present invention, arranged in alphabetical sequence from top to bottom of the running tool.

An articulated installation or running tool for installing the safety valve V of the present invention in the housing H is illustrated in FIGS. 9A, 9B and 9C. The running tool generally designated RT is provided with a pair of articulated ball joints located concentrically with the ball joints of the safety valve V as the valve V moves to the housing H to enable the running tool RT and the safety valve V to flex without interfering with the flexing of the other in moving around curves in the flowline such as that illustrated schematically in FIG. 13.

Referring now to FIG. 9A, an interface connector member 70 provides suitable means such as a threaded box connection **70*a* for interfacing the running tool RT with the TFL locomotive (not illustrated). The connector member 70 extends downwardly to form a skirt portion 70*b* terminating in the threads 70*c* which engage threads 72*a* of skirt extension tubular member 72. The tubular member 72 forms an inner surface 72*b* having an upwardly facing annular shoulder 72*c* disposed adjacent a smaller diameter inner surface portion 72*d*. Disposed within the tubular housing 72 is a tubular latch dog mounting sleeve member 74 having an enlarged head disposed above the upwardly facing annular shoulder 72*c* to provide a downwardly facing shoulder 74*a* engaging the shoulder 72*c* to connect the member 74 with the retrieving tool members 70 and 72. A threaded shear pin 76 is employed to prevent the shoulders 72*c* and 74*a* from moving out of engagement until it is desirable to releasably secure the safety valve V with the housing H. The member 74 is provided with a plurality of three equi-circumferentially spaced windows 74*c* receiving a corresponding plurality of three latch dogs 78 therein. Disposed within the tubular member 74 is a latch dog operator stem 80 having a collar 82 mounted thereon by threaded shear pin 81. The collar 82 engages an upwardly facing annular shoulder 84*a* formed by a tubular extension 84 of the tubular member 74 and which is secured to the tubular member 74 by threaded engagement at 84*b*. The latch dog operating stem 80 provides an upwardly facing annular surface 80*a* spaced a short distance from a downwardly facing surface 70*d* provided by the connecting member 70 inside the skirt 70*b*. The latch dog stem 80 is provided with an annular locking collar surface 80*b* and with releasing recesses 80*c* and 80*d* formed above and below the locking surface 80*b*, respectively. Thus longitudinal movement of the latch dog operating stem relative to the tubular member 74 will place the recess 80*c* or 80*d* adjacent the latch dogs 78 and able their inward movement to release the latch dogs 78**.

Located adjacent a lower end **74*d* of the member 74 is a ball forming member 86 that is secured to the tubular member 74 by threaded engagement at 87 while an enlarged ball or spherical head portion 86*a* is formed on the lower portion of the member 86. Surrounding the ball head portion 86*a* is a socket sleeve 88 and socket member 89 which are secured together by threaded engagement at 89*b*. The socket sleeve 88 is provided with a downwardly facing arcuate shoulder 88*a* engaging the ball 86*a* and holding the ball 86*a* in contact with the upwardly facing spherical recess 89*a* formed by the socket 89. Above the engaging surface 88*a* of the socket sleeve 88 an inner surface 88*b* is tapered outwardly to enable angular misalignment of the longitudinal axis of the secured socket sleeve 88 and socket 89 with the longitudinal axis of the ball forming member 86 and the upper tubular latch dog carrying sleeve 74**.

Secured to the lower end of the socket 89 is an extension member 90 extending downwardly to form a downwardly facing arcuate surface **90*a*. Disposed radially outwardly of the member 90 is a tubular intermediate latch dog carrying housing 92 having an upper guide ring 94 secured thereto by threaded engagement at 93. The guide ring 94 provides a downwardly facing annular shoulder surface 94*a* adapted to engage an upwardly facing annular shoulder 90*b* formed by the locking collar 90*c* of the member 90. Sleeve 92 forms a plurality of equi-circumferentially spaced windows 92*a* in which are disposed a plurality of latch dogs 96. The latch dogs 96** are movable between the outer or locking position of FIG. 9B and an inner or released position when the locking collar 90c moves upward relative to the dogs 96 so the dogs may move inwardly into the recess 90d located adjacent the arcuate surface 90a. Secured to the sleeve 92 is a socket forming sleeve 98 that is similar in structure and function to the socket sleeve 86. The socket sleeve 98 is secured to the sleeve 92 by threaded engagement at 99 and forms an upwardly facing arcuate surface 98a which is cut away at 98b to provide clearance for the annular misalignment of the portions of the running tool RT.

Disposed above the shoulder 98a and below the arcuate surface 98 is a spherical or ball enlargement portion 100aa of a connecting member 100. The connecting member 100 is in turn threadedly connected at 101 (FIG. 9C) with a lower connecting member 102 which is in turn connected with a nose member 104 by threaded engagement at 103. The connector member 100 is provided with an enlarged outer portion 100a and a lower recess portion 100b. Mounted outwardly of the connecting member 100 is a sleeve 106 having a plurality of equally circumferentially spaced windows 106a formed thereon and having a corresponding plurality of latch dogs 108. When the connecting member 100 is moved upwardly relative to the sleeve 106 the latch dogs 108 are enabled to move relatively inwardly for releasing the latch dogs 108 from engagement with the safety valve V.

Mounted on the member 102 is a slidable latching collet sleeve 110 having a plurality of upwardly extending spring fingers 110a with each of the fingers 110a having an enlarged head or boss 100b. The collet sleeve is secured to the member 102 by a suitable shear means such as shear pin 112 for holding the bosses 110b adjacent an enlarged outer diameter portion 102b of the member 102. Disposed below the locking shoulder 102b is an annular recess 102c in which the bosses 110b are adapted to move when the shear pin 112 is sheared and the collet is free to fall downwardly to engage the nose 104. Located above the collet heads 110b is an outwardly projecting collar 102d formed by the member 102. The collar 102d forms a downwardly facing annular shoulder 102e and upwardly facing shoulder 102f for purposes to be described hereinafter.

Figure 11A:
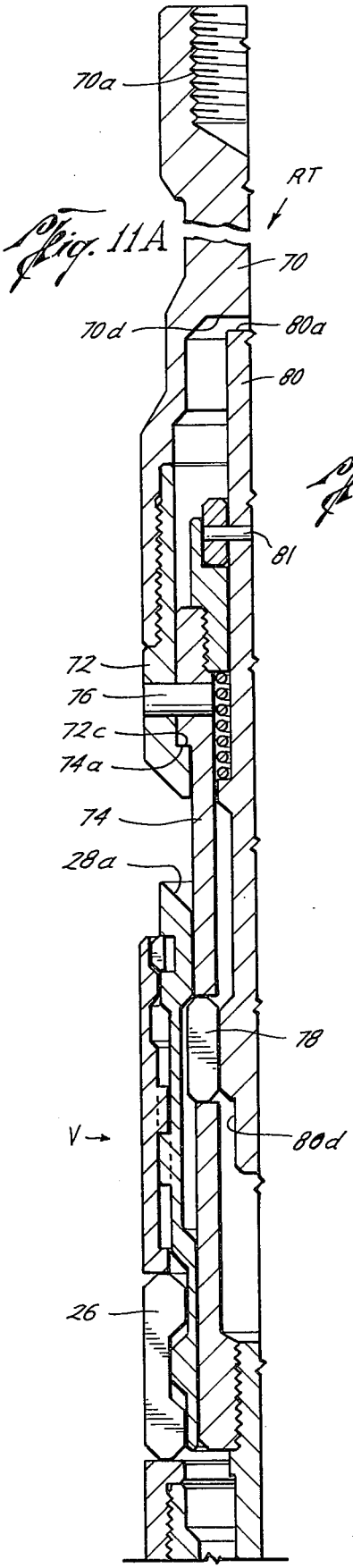
FIGS. 11A, 11B and 11C are side views, in section, arranged in alphabetical sequence from top to bottom of the running tool positioned in the safety valve for installing the safety valve.
Figure 11B:
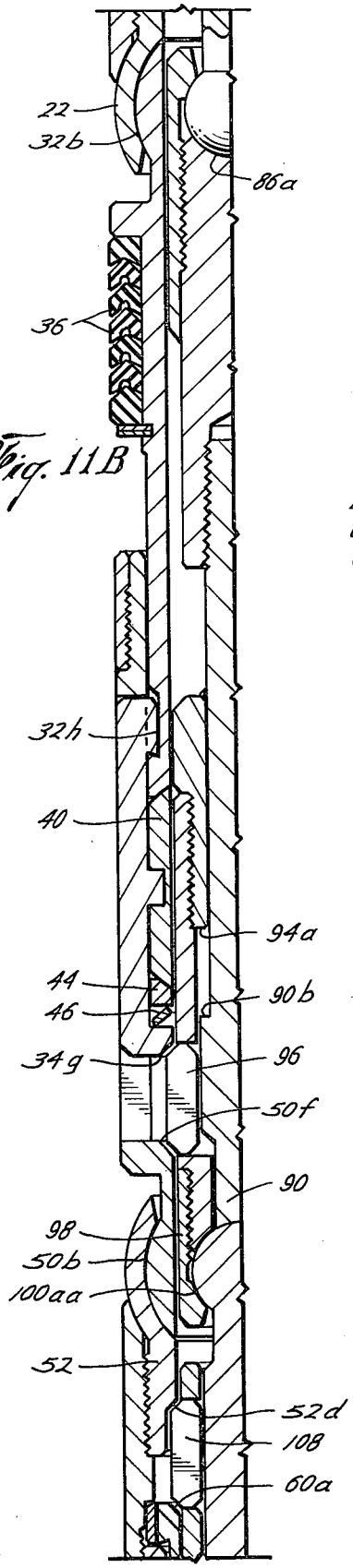
Figure 11C:
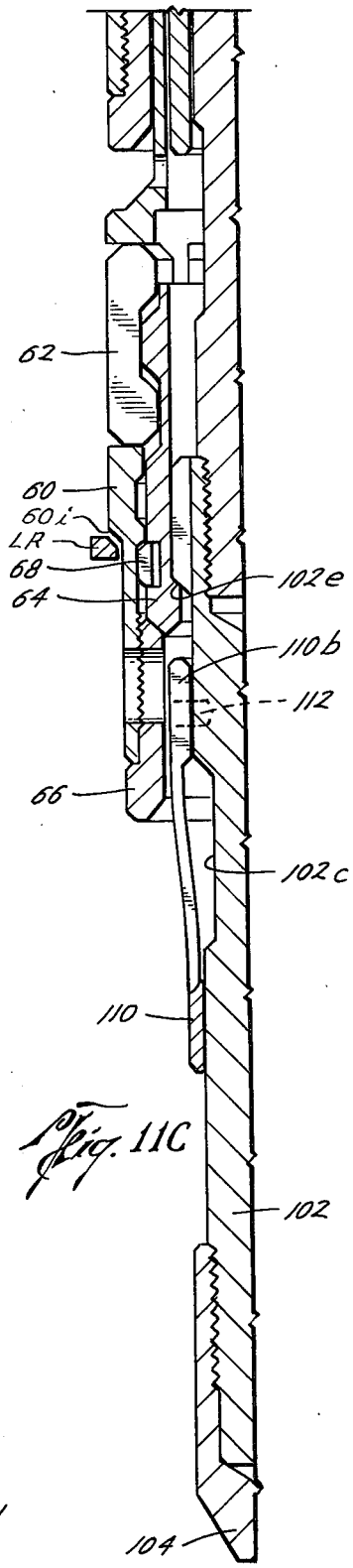

The relationship of the running tool RT and the mounted safety valve V for installing the valve V in the well is illustrated in FIGS. 11A, 11B and 11C. In viewing FIG. 11B it is immediately appearent that the upper ball 32b and socket 22 universal joint of the valve V and the upper ball 86a and socket joint of the running tool T are aligned and concentrically positioned as well as the lower universal joints to eliminate any interference with the flexing of the valve V and running tool RT during installation operations.

During installation the running tool RT is connected to the TFL locomotive using box threads 70a for circulating down the flowline. Prior to the time of connecting the running tool RT with the TFL locomotive, it is necessary to operably position or mount the safety valve V on the running tool RT.

Referring now to FIG. 11A the running tool latch dog 78 is locked outwardly positioned in the latch dog operating recess 28d of the frame latch dog operating sleeve 28 and serves to enable reversing TFL movement of the valve V by reversing the TFL flow should the valve V become hung up in moving to the housing H. The latch dog 78 thus enables the tool to be backed away from an obstruction before making another attempt to move the safety valve V past the obstruction. The spacing of the latch dogs 78 and 96 prevent the dogs 78 from inadvertently moving the latch sleeve 28 downwardly.

The running tool latch dogs 96 are positioned between the downwardly facing annular shoulder 34g of the frame cage 34 and the upwardly facing annular shoulder 50f of the ball moving operator 50 for holding the ball 40 in the open position during running operations. The running tool latch dog 108 is positioned between the upwardly facing annular shoulder 60a of the operator sleeve 60 and the downwardly facing shoulder 52d of the socket 52. The dog 108 thus serves to maintain the operator means M in the extended position until the valve is initially operated closed which enables the operating stroke length adjustment detent ring 58 to move between the shoulders 56b and 60b.

Figure 10A:
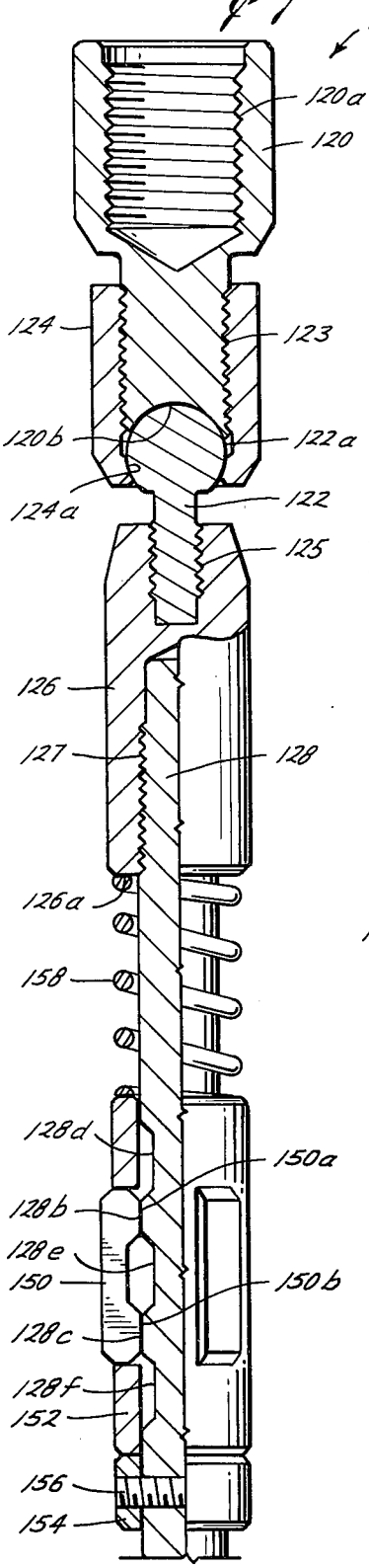
FIGS. 10A, 10B and 10C are side views of the subsurface safety valve retrieving tool of the present invention, arranged in alphabetical sequence from top to bottom of the retrieving tool.
Figure 10B:
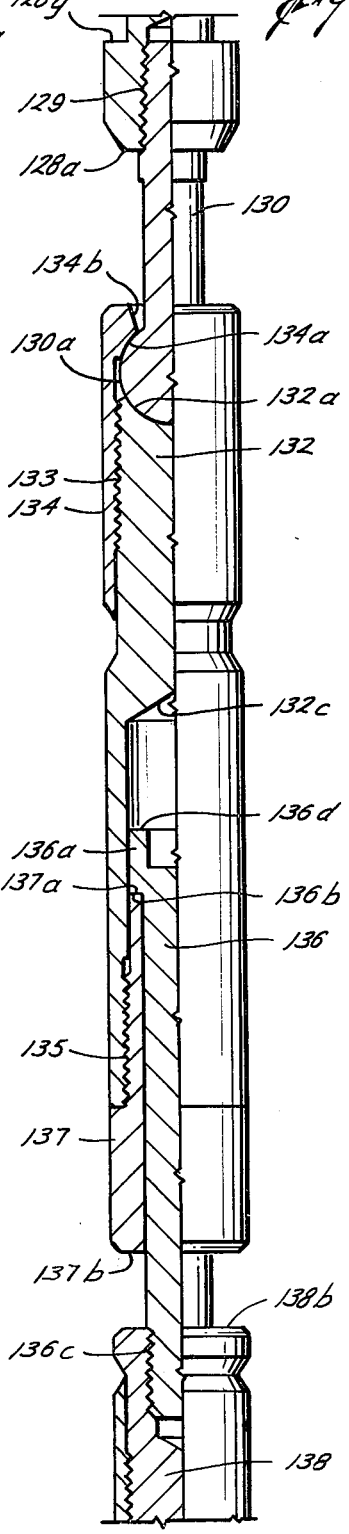

The pulling tool, generally designated PT, of the present invention is illustrated in FIGS. 10A–10B. The pulling tool PT is provided at its upper end with a connecting member 120 having suitable box threads 120a for interfacing with the TFL locomotive. The connecting member 120 is provided with a downwardly facing spherical recess 120b for receiving an enlarged spherical or ball head 122a of the member 122. Secured to the connecting member 120 by threaded engagement 123 is a connector sleeve 124 providing an upwardly facing arcuate surface 124a engaging the lower portion of the spherical head 122a for securing the ball member 122 with the socket 123.

The ball member 122 is connected by threaded engagement at 125 with an enlarged head 126 forming a downwardly facing annular shoulder 126a. Extending downwardly from the member 126 and threadedly secured thereto by threaded engagement at 127 is a latch dog operating stem 128 and which mounts at its lower end 128a a ball forming member 130 which is secured thereto by threaded engagement at 129 with the ball forming member 130 having an enlarged spherical or ball head 130a. A socket member 132 forms an upwardly facing spherical recess 132a receiving the ball 130a for forming the ball and socket connection with a socket sleeve 134 disposed about the ball portion and that is threadedly secured to the socket 132 by threaded engagement at 133. The socket sleeve 134 provides a downwardly facing annular spherical surface 134a engaging the upper portion of the ball enlargement 130a for connecting the socket member 132 with the ball 130. The ball engaging surface 134 is cut away at 134b to enable the desired longitudinal universal misalignment.

Figure 10C:
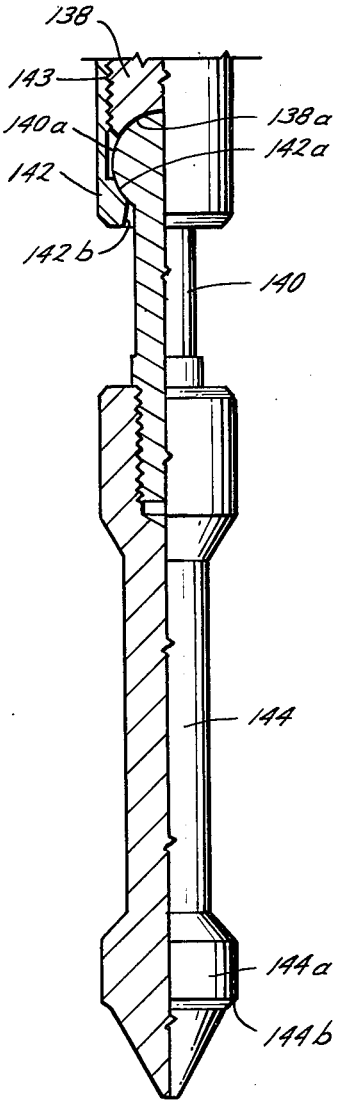

Secured to a lower skirt portion 132b of the socket member 132 by suitable means is a keeper ring 137 such as threaded engagement at 135. The keeper ring 137 provides an upwardly facing annular shoulder 137a within the skirt portion 132b and a downwardly facing shoulder 137b. Movably disposed within the keeper ring 137 is an extension rod 136 having an enlarged head 136a forming a downwardly facing annular shoulder 136b engaging the keeper ring shoulder 137a for connecting the socket member 132 and the extension rods 136 while enabling limited relative longitudinal movement. The extension rod 136 forms a threaded connector 136c for connecting with the universal joint socket 138. The universal joint socket 138 forms a downwardly facing spherical recess 138a (FIG. 10c) for receiving an enlarged spherical or ball head 140a formed by the ball member 140. Secured about the socket 138 is a socket sleeve 142 which is secured by threaded engagement at 143 to the socket 138 and which provides an upwardly facing arcuate surface engaging the lower portion of the ball enlargement 138*a* for securing the ball member 140 with the socket member 138. The locking surface 142*a* is recessed at 142*b* to enable the universal movement of the ball 138*a* in the socket 138. Connected to the lower end of the ball member 140 is the releasing nose member 144 having an enlarged head 144*a* for forming a downwardly facing unlocking shoulder 144*b* that is dimensioned to engage the upwardly facing shoulder 64*i* of the lower operator latch sleeve 64.

The nose 144*a* is dimensioned to pass through the opened secured safety valve V to enagage the latch sleeve 64 by the shoulder 64*i* to move the opertor latch sleeve downwardly to the released position for releasing the latch dogs 62. In effecting this operation the extension 136 is moved upwardly relative to the socket member 132 until the upper annular shoulder 138*b* of the socket 138 engages the shoulder 137*b* of the keeper ring 137. Such engagement is arranged to occur before shoulders 136*d* and 132*c* could engage. This lost motion linkage assures that the plurality of latch dogs 150 carried by the sleeve 152 exteriorly of the latch dog operating stem 120*a* will move into the frame latch sleeve operating recess 28*d* for effecting upward movement of the latch sleeve 28 to effect release of the dogs 26 as the retrieving tool PT moves upwardly from the safety valve V.

Disposed below the tubular member 152 (FIG. 10A) is a securing ring 154 which is secured to the latch dog operating stem 128 by shear pin 156. The latch dog operating stem 128 is provided with a pair of spaced annular locking surfaces 128*b* and 128*c* that engage the latch dog locking surfaces 150*a* and 150*b*, respectively, to hold the latch dog 150 in the radially expanded position. Formed in the latch dog operating stem 120*a* adjacent the latching surfaces 128*b* and 128*c* are a plurality of recesses for enabling inward movement of the latch dog 150 to the released position. The upper and lower recesses 128*d* and 128*e* receive the locking surfaces 150*a* and 150*b*, respectively, when the latch dog 150 encounters a restriction in moving to the safety valve V. The biasing of spring 158 tends to urge the sleeve 152 to the lower position in engagement with the keeper ring 154 except when an obstacle is encountered and at which time the latch dog 150 forces the sleeve 152 to move upwardly and enable the latch dogs 150 to move radially inwardly to pass the restriction. When the restriction is passed the spring 158 urges the sleeve 152 to move downwardly and force the latch dogs 150 outwardly. With this arrangement it is apparent that the latch dogs 150 will move radially inwardly when encountering the upwardly facing annular shoulder 28*a* of the upper latch sleeve and will expand radially outwardly to the locking position when aligned with the recess 28*d*.

With the latch dogs 150 positioned in the recess 28*d* and the nose 144*b* having moved the lower latch sleeve 64 to the lower position by engagement with the shoulder 64*i* TFL circulation may be reversed to flow the safety valve V from the housing H back to the surface. The initial upward movement will bring the latch dogs 150 into engagement with the upper portion of the latched recess 28*d*. When the latch dogs 150 move in this direction they are unable to move off the locking surfaces 128*b* and 128*c* for retrieving the valve V back to the surface by intially pulling the upper latch sleeve 28 to the upper position to release the latch dogs 26 and to enable movement of the safety valve V from the housing H. If for any reason the tool is unable to move the upper latch sleeve 28 upwardly to effect release the shear pin 156 may be sheared by an upward jar and which will enable the locking surfaces 150*a* and 150*b* to move into the recess 128*e* and 128*f*, respectively, of the latch dog operating stem 120*a* in order that the pulling tool PT will release the valve V for circulation back to the platform K. The latch dog operating stem 128 forms an upwardly facing annular shoulder 128*g* for retaining the securing ring 154 with the running tool and thereby eliminating the loss of the ring 154 in the well.

OPERATION OF THE PRESENT INVENTION

The housing H and control fluid conduits CF-1 and CF-2 are installed when running the well tubing S and S-1 during well completion operations. After connecting the flowlines U and U-1 with the well head assembly loops L and L-1 it may become desirable to install the subsurface safety valve V of the present invention.

The valve V is assembled on the running tool RT in the manner illustrated in FIGS. 11A–11C and the running tool RT connected with a TFL locomotive. The manifold means M are then employed to effect circulation through the flow conduit U and well head loop L into the production tubing S and outwardly from the production tubing S through the crossover tool Z into the second tubing string S-1 and well head loop L-1 back through the flowline U-1 to the production platform K. Such flow enables the TFL carrier locomotive to move the running tool RT and the safety valve V through the flow conduit U into the well head loop L by flexing the tool at the universal ball and socket joints as the tool moves through the loop L and into the bore of the production tubing S where it passes downwardly into the well. It should be noted that the well tubing S and flow conduit U frequently have various bends and curves formed therein and these bends or curves may also form restrictions to the passing of the prior art surface-controlled valves which is overcome by the flexing of the safety valve V at the ball and socket connections. When the safety valve V moves into the housing H a downwardly facing positioning annular shoulder 60*i* formed by outer surface 60*d* of operator sleeve 60 engages the radially constrictable positioning ring LR (FIG. 11C) mounted with the housing H for blocking further movement of the safety valve V through the bore of the well tubing S. The positioning ring LR also serves to position the frame securing latch dogs 26 adjacent the annular securing recess formed in the bore of the housing H and for positioning the operator lower latch dogs of the valve V adjacent the recess DR and the control member D that is reciprocately mounted with the housing H. With the shoulder member 66 engaging the constricting ring to block further downward movement of the valve *v* and the running tool RT a sufficient downward force is supplied from the locomotive train through the connection at 70*a* either by increased fluid pressure or a downward jar to effect shearing of the shear pin 76 (FIG. 11A) for moving the members 72 and 70 downward relative to the tubular member 74. Upon shearing of the pin 76 the member 72 moves downwardly for engaging the upwardly facing shoulder 28*a* of the upper latch sleeve 28 with the downwardly facing shoulder 72*e* formed by the member 72. With the running tool latch dogs 78 positioned in the recess 28*d* the upper latch sleeve 28 is not able to move the entire distance to the latched position until the latch dogs 78 are released. This is accomplished by the downwardly facing shoulder 70*d* of the member 70 engaging the upwardly facing shoulder 80*a* of the dog releasing stem 80 substantially immediately after the shearing of the pin 76 and thereafter shearing the shear pin 81 to enable movement of the locking dog steam 80 downwardly relative to the latch dogs 78 to place the recess 80*c* adjacent the latch dogs 78 and enable the latch dogs 78 to move radially inwardly for freeing the latch sleeve 28 for movement to the lower position.

With the upper latch sleeve 28 in the lower position the frame latch dogs 26 are forced radially outwardly into the recess of the housing H for securing the safety valve V at the desired subsurface location. At this time the TFL circulation flow is reversed by the manifold means M for moving the running tool RT from the housing H back to the surface through the well tubing S and flow loop L and flow conduit U. The upward movement of the running tool RT brings the bosses 110*b* of the collet 110 into engagement with the downwardly facing annular shoulder 64*a* of the operator latching sleeve 64. With the bosses 110 in engagement with the annular shoulder 64*a* a sufficient upward force is applied by the running tool RT either by the use of jars or by increased fluid circulating pressure to effect upward movement of the operator latching sleeve 64 from the lower to the upper position and which movement forces the latch dogs 62 radially outwardly into the recess DR of the control member D as is illustrated in FIG. 12 for securing the operator means M with the control frame D.

With the latch sleeve 64 in the upper position, the shear pin 112 then shears enabling the collet 110 to drop downwardly to position the bosses 110*b* adjacent the recess 102*c* in order that the bosses 110*b* may be flexed inwardly and enabling passage of the running tool upwardly past the annular shoulder 64*a* and out of the valve V.

The above described operations are necessary for understanding the securing of the safety valve V in the housing H but the operation of securing is complicated by necessity to also release the running tool latch dogs 96 and 108. The latch dogs 96 are released for freeing the ball for longitudinal movement prior to the bosses 110*b* moving into engagement with the shoulder 64*a* for effecting securing movement of the lower operating sleeve 64. The dogs 108 are released after shearing of the shear pin 112 which occurs after securing of the operator sleeve 60 with the control member D.

Upon completion of the latching of the upper sleeve 28, the latch dogs 78 of the running tool are received within the tubular member 74 and are no longer connected with the safety valve V. The initial upward movement effected in reversing circulation to move the TFL locomotive away from the housing H will bring the shoulders 72*c* and 74*a* into engagement for moving the member 74*a* and which will pull the running tool ball member 86 directly upwardly with the sleeve 74. The latch dog operating stem 90 is connected by threads 89*b* to the socket 89 and will move upwardly with the sleeve 74 until the upwardly facing annular shoulder 90*b* engages the downwardly facing shoulder 94*a* of the running tool carry sleeve 92 mounting latch dogs 96. This relative movement enables the stem recess 90*d* to move adjacent the latch dogs 96 and enable the latch dogs 96 to move radially inwardly as they are wedged upwardly with the running tool RT.

When the member 90 commences to lift the sleeve 92 the ball member 100 commences to move upwardly relative to the latch dogs 108 and the sleeve 106 carrying the latch dogs. The latch dog 108 serves to hold the operator linkage in the extended position and the latch dogs 108 will prevent movement of the sleeve 106 until the recess 100*b* moves upwardly adjacent the latch dogs 108 at which time they are free to move inwardly and then enable the sleeve 106 to move upwardly with the latch dogs 108. The latch dogs 108 are released after the bosses 110*b* have engaged the shoulder 64*a* and moved the latch sleeve 64 to the upper position for effecting securing of the operator sleeve 60 with the control member D and subsequent shearing on pin 112.

When it becomes desirable to retrieve the subsurface safety valve of the present invention from the housing, the retrieving tool PT connected to the TFL locomotive in the normal manner and circulated down through the flow conduit U through the loop L of the well head assembly W and down the bore of the production tubing S to the housing H. The nose 144*a* of the retrieving tool will move through the bore of the operated open safety valve V until the shoulder 144*b* engages the upwardly facing shoulder 64*i* of the lower or operator latch sleeve 64. When the lost motion linkage slack is taken up by engagement of the shoulders 137*b* of the keeper 137 with the shoulder 138*b*, the latch sleeve 64 will be moved to the lower position for enabling release of the lower latch dogs 62 from the recess DR of the control member D.

The lost motion linkage of the retrieving tool DT insure that the latch dogs 150 will move properly into the latch operating recess 28*d* of the frame latch sleeve 28 and may in fact even move partially below the recess 28*d* during unlatching of the sleeve 64. Upon reversal of the pulling tool PT the latch dogs 150 will expand radially outwardly into the recess 28*d* of the frame latch sleeve 28 and be held in the outer position on locking surfaces 128*b* and 128*c* by the shear pin 156 blocking downward movement of the sleeve 152 carrying the latch dogs 150. The latch dogs 150 will then pull the latch sleeve 28 upwardly relative to the frame sleeve 20 and enabling release of the latch dogs 26. Upon the latch sleeve 28 moving to the upper position the continued upward movement of the pulling tool PT will wedge the latch dogs 26 inwardly in the windows 20*a* to release the subsurface safety valve V from the housing H and enable movement upwardly to the production tubing S and through the well head loop L into the bore of the flow conduit U back to the platform K.

The TFL operations then may be repeated to install a new subsurface safety valve V in the housing H as desired and which can be retrieved in the aforesaid manner. Such operations enable the installation and removal of the subsurface safety valve V from the housing H as desired without employing a work over vessel to be positioned over the well head apparatus W.

The running tool RT as illustrated in FIGS. 9A, 9B, 9C, 11A, 11B and 11C omits various flow passages in the tool for enabling a certain amount of fluid flow through the valve V and running tool RT to compensate for fluid leakage past the locomotive when installing the safety valve V and to enable operating movement of the running tool RT. The use of such venting or flow passing passages are well known to those skilled in the art, but have been omitted in the figures to simplify understanding of the present invention.

The foregoing disclosure and description of the invention are illustrative and explanatory thereof, and various changes in the size, shape and materials as well as in the details of the illustrated construction may be made without departing from the spirit of the invention.

I claim:

1. A running tool apparatus for installing an articulated surface-controlled safety valve having a valve element and valve operator at a subsurface operating location in a well using through-the-flowline techniques, including:

a running tool body having means for connecting with a carrier tool for moving the running tool to and from the subsurface valve operating location in the well, said running tool body extending within the articulated safety valve body;

means mounted with said running tool body for releasably securing the articulated safety valve with the running tool body;

means mounted with said running tool body for operating the articulated safety valve to releasably secure the safety valve at the subsurface operating location in the well;

means mounted with said running tool body for releasing the secured articulated safety valve from the running tool to enable movement of the running tool from the safety valve; and said running tool body having a first body portion and a second body portion and means for connecting said first body portion and said second body portion for enabling angular movement of said first body portion relative to said second body portion wherein said running tool body flexes, said means for connecting said first body portion and said second body portion disposed within the articulated safety valve when moving the safety valve to the subsurface operating location.

2. A running tool apparatus for installing an articulated surface-controlled safety valve having a valve element and valve operator at a subsurface operating location in a well using through-the-flowline techniques, including:

a running tool body having means for connecting with a carrier tool for moving the running tool to and from the subsurface valve operating location in the well;

means mounted with said running tool body for releasably securing the articulated safety valve with the running tool body;

means mounted with said running tool body for operating the articulated safety valve to releasably secure the safety valve at the subsurface operating location;

means mounted with said running tool body for releasing the secured articulated safety valve from the running tool to enable movement of the running tool from the safety valve;

said running tool body having a first body portion and a second body portion and means for connecting said first body portion and said second body portion for enabling angular movement of said first body portion relative to said second body portion wherein said running tool body flexes; and said first body portion mounting said means for connecting; and said first body portion locating said means for connecting concentric with the articulated joint of the safety valve enable the running tool and articulate safety valve to flex without interfering with the flexing of the other.

3. The apparatus as set forth in claim 2, including:

a third running tool body portion;

means for connecting said second body portion and said third body for enabling angular movement of said third body portion relative to said second body portion; and said second body portion locating said means connecting said second and third body portions concentric with a second articulated joint of the safety valve to enable the running tool and articulated safety valve to flex without interfering with the flexing of the other.

* * * * *